United States Patent [19]

Ruff et al.

[11] Patent Number: 4,469,981

[45] Date of Patent: Sep. 4, 1984

[54] CIRCUIT FOR THE OPERATING OF GAS DISCHARGE LAMPS

[75] Inventors: Reinhard Ruff, Feldkirchen; Friedrich Haydn, Deutschlandsberg; Horst Ebhardt, Graz, all of Austria

[73] Assignee: Elektro Neon Elger Ges.m.b.H. Dr. H. Ebhardt and H. Stark, Graz, Austria

[21] Appl. No.: 380,862

[22] PCT Filed: Sep. 10, 1981

[86] PCT No.: PCT/AT81/00022

§ 371 Date: Apr. 30, 1982

§ 102(e) Date: Apr. 30, 1982

[87] PCT Pub. No.: WO82/01113

PCT Pub. Date: Apr. 1, 1982

[30] Foreign Application Priority Data

Sep. 11, 1980 [AT] Austria ..... 4581/80

[51] Int. Cl.[3] ..... H05B 41/16

[52] U.S. Cl. ..... 315/205; 315/171; 315/173; 315/240; 315/290; 315/DIG. 7

[58] Field of Search ..... 315/171, 173, 205, 240, 315/239, 290, DIG. 7

[56] References Cited

U.S. PATENT DOCUMENTS 3,334,270 8/1967 Nuckolls ..... 315/171
3,448,336 6/1969 Hochstein ..... 315/173

FOREIGN PATENT DOCUMENTS 1945095 9/1969 Fed. Rep. of Germany .
2020786 11/1970 Fed. Rep. of Germany .
2758872 7/1979 Fed. Rep. of Germany .
472168 6/1969 Switzerland .

*Primary Examiner*—Eugene R. LaRoche
*Attorney, Agent, or Firm*—Martin A. Farber

[57] ABSTRACT

In a circuit for the operating of gas discharge lamps in which a starting circuit (2, 17) having a starter transformer (17) and a source of auxiliary voltage which can be disconnected after starting has been effected are provided for the starting of the lamp, there is provided a full-wave rectifier (6) with which a charging capacitor (10) and a voltage-dependent electronic switch element (8) are connected in parallel. A switch contact (9) which is in series with the charging capacitor (10) can be actuated by the switch element (8). The charging capacitor (10) which supplies the operating voltage for the gas discharge lamp (3) can be charged to a voltage which can be selected by means of the switch element (8). The full-wave rectifier (6) which serves a source of auxiliary voltage can be disconnected by means of a control element (4) from the gas discharge lamp (3) after the latter has been started. The starting circuit (2, 17) is connected to the charging capacitor (10), the secondary winding of the starter transformer (17) being connected to the gas discharge lamp (3) separately from the operating circuit of said lamp.

13 Claims, 8 Drawing Figures

Fig. 1
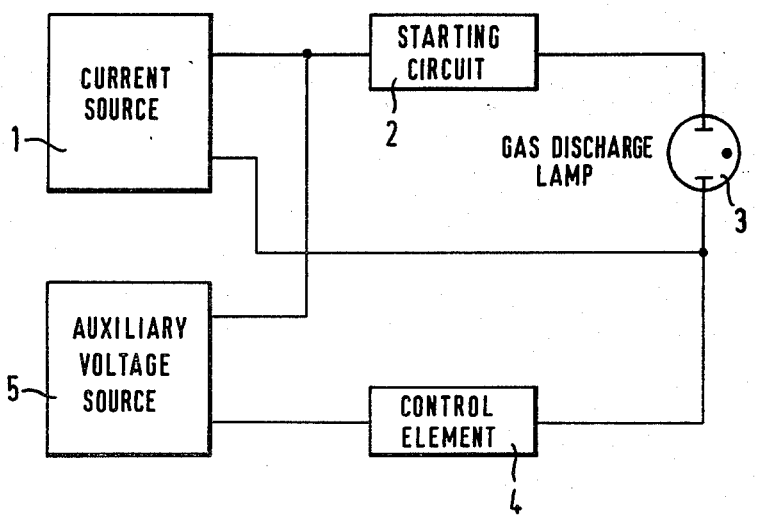
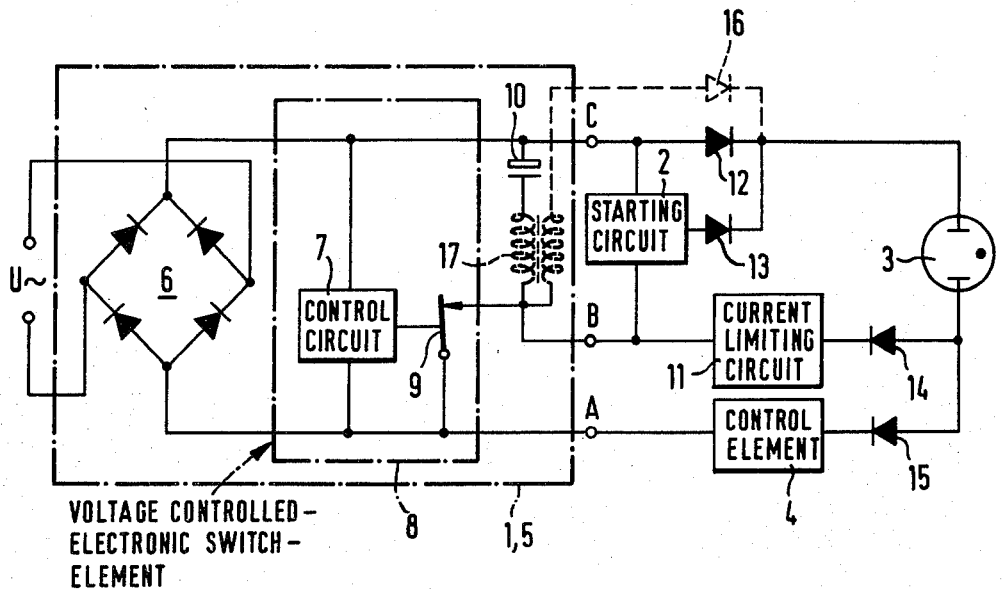
Fig. 2

CIRCUIT FOR THE OPERATING OF GAS DISCHARGE LAMPS

The present invention relates to a circuit for the operating of gas discharge lamps, particularly fluorescent tubes, in which the gas discharge lamp is connected to a source of current, particularly a source of direct current, a starting circuit which has a starter transformer being provided for the starting of the gas discharge lamp as well as a source of auxiliary voltage which can be disconnected after starting.

One generally distinguishes between two different types of gas discharge lamps based on the construction of the electrodes, namely lamps with preheatable electrodes (coiled-filament electrodes), which require a relatively low starting voltage, and lamps with non-preheatable electrodes which require higher starting voltages.

In alternating-current operation, for the starting and operating of gas discharge lamps having preheatable electrodes, inductors (series reactors) are generally used for the limiting of the current and, together with a starter connected in parallel with the lamp for the starting. The preheating of the electrode limits the life of the lamp due to the thermal stressing of the incandescent filament. Furthermore, the starting of the lamp is generally not effected upon the first attempt to start by the starter, resulting in a so-called flickering start.

In the case of a defective lamp it may happen that the electrodes are continuously heated since the lamp does not start. The series reactor must, on the one hand, be of high enough inductance to sufficiently limit the lamp current or generate a large enough starting peak, as a result of which a large number of turns is necessary; on the other hand, the entire current of the lamp flows through the winding, as a result of which the dimensions and the weight of the reactor become relatively large. If the diameter of the wire is reduced, the ohmic losses of the reactor increase, as a result of which the economy of the arrangement is reduced and heating thereof occurs.

In lamps with non-preheated electrodes, use may be made for starting and operation of a transformer which, when connected, produces such a high, powerful starting peak that the starting of the lamp is assured. The transformers used in this connection are, however, in their turn, relatively large arrangements of expensive construction. Furthermore, due to the high, powerful starting peak required the life of the lamp is substantially reduced, in general by 30 to 50%.

Starting and operating arrangements for the operating of gas discharge lamps with direct current operate with the use of a multiplier circuit with charging capacitors and inductors (smoothing chokes) in order to reduce the harmonic content. The disadvantage of these arrangements, aside from the large dimensions of their individual component parts, is the fact that the lamp burning voltage must correspond approximately to the DC voltage in order to assure economic operation. Arrangements of this type, furthermore, have a capacitive cos $\phi$ of 0.5 which must be compensated for.

The known starting and operating devices for alternating current operation as well as the arrangements indicated for direct-current operation are of considerable dimensions and considerable weight, which is undesirable. Furthermore, when the ordinary starting devices are used the lamps are so acted on by high energy-rich starting peaks upon the starting process that a reduction of 30 to 50% in the life of the lamp generally results.

The purpose of the present invention is to create a circuit of the aforementioned type in which the disadvantages of the known circuits are avoided and, in particular, a substantial reduction in the spatial dimensions and weight of the starting and operating system is obtained, particularly in order to permit the construction of gas discharge lamps in the form of lamps units which can be screwed into ordinary incandescent lamp sockets and, by the gentle type of ignition selected, to obtain a substantial improvement, particularly in the case of direct current operation. Another object is to increase the life of the gas discharge lamps as much as possible by a starting which takes place without energy-rich voltage peak and by elimination of the preheating of the electrodes.

In accordance with the invention a full-wave rectifier is provided as source of current and there are connected in parallel to it a charging capacitor and a voltage-dependent electronic switch element by which a switch contact lying in series with the charging capacitor can be actuated, the charging capacitor which supplies the operating voltage for the gas discharge lamp being adapted to be charged to a voltage which can be selected by means of the switch element and the full-wave rectifier serving as source of auxiliary voltage for the gas discharge lamp, it being adapted to be disconnected after the starting of the gas discharge lamp via the control element which is developed in particular as a semiconductor switch element, the starting circuit being connected with the charging capacitor and the secondary winding of the starter transformer being connected to the gas discharge lamp separately from the operating circuit of the latter.

The circuit of the invention assures particularly light weight, small dimensions and low power dissipation. The source of current necessary for the operation of the gas discharge lamp is in this connection formed by the capacitor, and the source of auxiliary voltage by the full-wave rectifier.

Due to the fact that a source of auxiliary voltage is applied to the gas discharge lamp for starting in addition to the starting voltage which is supplied by the starting generator to the gas discharge lamp, instant start is obtained, with the greatest possible protection of the electrodes of the gas discharge lamp, and with the possibility also of keeping the starting circuit itself extremely simple.

The design of the circuit for direct current avoids a stroboscope effect and assures optimal utilization of the lamp current and thus better efficiency.

The predominant part of the circuit in accordance with the invention can be manufactured in the form of an integrated circuit, whereby not only can the size and weight be reduced but manufacture can also be effected more economically. Another advantage of the circuit of the invention is the possibility of dimming the brightness of the lamp by a factor of 3 to 5 practically without loss by varying the value of a single ohmic resistor.

The circuit of the invention also permits the cold starting of gas discharge lamps of limited tube length when operating on 110 volt alternating voltage. Finally, a reduction of about one-half of the power dissipation present in ordinary starting and operating arrangements is obtained.

A cataphoresis effect which occurs during the operation of the lamp in DC operation (migration of the mercury towards the working electrode) does not occur in lamps of a length of up to 50 cm since the rate of migration of the mercury is counteracted by the backward diffusion.

For longer tubes a periodic reversal in polarity of the lamp current can be provided, the gentle type of starting being of great advantage here also.

As starting device an ordinary arrangement can be used which supplies the necessary voltage pulses in combination with a small starter transformer.

The primary winding of the starter transformer may advisedly be connected in series with the charging capacitor.

An advantageous variation here consists in connecting a series connection of a resistor and a capacitor in parallel with the charging capacitor, a series connection of a thyristor tetrode, a four-layer diode or the like and of the primary winding of the starter transformer being connected in parallel with the capacitor.

The voltage of the source of current changes upon operation of the gas discharge lamp in the manner that its value when the gas discharge lamp is not lit is higher than when the gas discharge lamp is lit. In this way the pulses are produced only when the lamp has not yet been started and the arrangement automatically ceases to operate when the gas discharge lamp has started.

The starter transformers used differ essentially from the transformers for the starting and operating of gas discharge lamps with alternating current which were described at the beginning hereof, since they need only produce voltage peaks of very low energy and therefore are of very light weight and very small volume (less than 1 $cm^3$).

Further details of the invention will become evident by reference to the drawing in which a several embodiments are shown.

FIG. 1 shows the principle of the circuit of the invention;

FIG. 2 shows an embodiment with charging capacitor which supplies the operating voltage for the gas discharge lamp;

Figure 3:
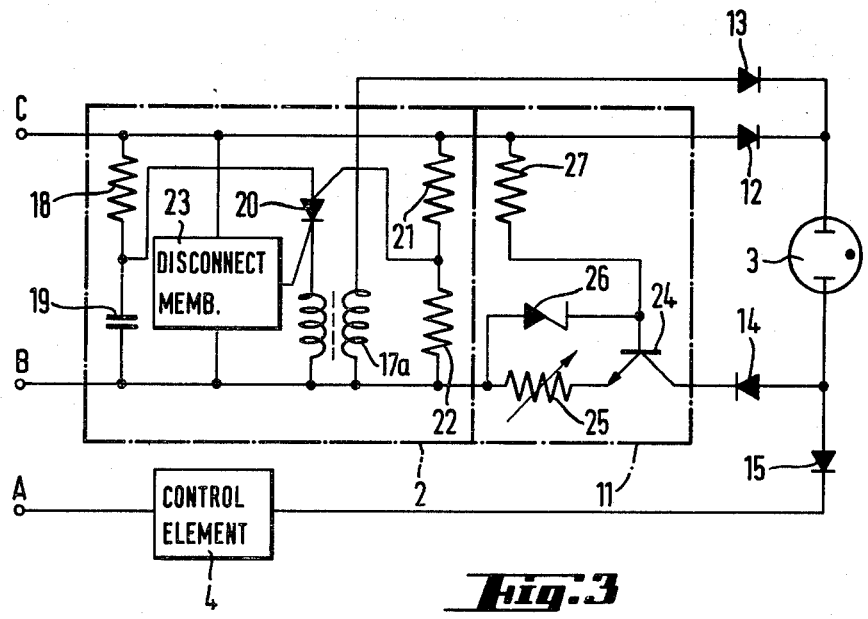
FIG. 3 shows an embodiment which has a starting circuit containing a thyristor.

In the basic diagram shown in FIG. 1, the one pole of a gas discharge lamp 3 is connected via a starting circuit 2 to one pole of a source of current 1. The other pole of the gas discharge lamp 3 is connected on the one hand to the other pole of the source of current 1 and on the other hand, via a control element 4, to the source of auxiliary voltage 5.

For the starting of the gas discharge lamp 3 the starting circuit 2 on the one hand enters into action by producing voltage peaks of high voltage but very low energy while on the other hand the control element 4 connects the gas discharge lamp 3 to the auxiliary voltage source 5 whose voltage is a limited amount higher than the lamp burning voltage. This combination makes it possible without preheating of the electrodes to start a gas discharge lamp with starting pulses of very low energy or with relatively low starting voltages produced by the source of auxiliary voltage 5.

In the embodiment shown in FIG. 2, the source of current 1 comprises a full-wave rectifier 6 to whose output there is connected a voltage-controlled electronic switch element 8 which contains a control circuit 7 by which there is actuatable a switch contact 9 via which a charging capacitor 10 can be connected to the full-wave rectifier 6. In parallel with the charging capacitor 10 there is the starting circuit 2 to which the series connection of the gas discharge lamp 3, a diode 14 and a current limiting circuit 11, for instance a source of constant current, is connected via diodes 12, 13. At the junction of the gas discharge lamp 3 with the diode 14 there is located the series connection of a diode 15 and of the control element 4 which leads to one output of the full-wave rectifier 6.

The electronic switch element 8 has the property of holding the switch contact 9 closed below a given voltage and holding it open above that voltage.

The switch contact 9 is connected to the input terminals of the full-wave rectifier 6 upon the application of an alternating voltage. In this way the charging capacitor 10 is charged to the absolute value of the voltage applied at the time. When the alternating voltage reaches a given selectable value the switch contact 9 is opened and the charging process at the charging capacitor 10 is interrupted. When the charging voltage again reaches the said value, the charging capacitor 10 is again charged. This charging process is carried out four times every cycle since the absolute value of the input voltage both on the ascending and on the descending branch of the half wave and both in the positive and in the negative half wave reaches a value which leads to the closing of the switch contact 9. During the course of the charging process the charging capacitor 10 is charged to a voltage which is somewhat higher than the lamp burning voltage but less than the output voltage of the full-wave rectifier 6, which voltage can be selected by the response voltage of the control circuit 7, for instance by means of a voltage divider.

The full-wave rectifier 6 at the same time constitutes the source of auxiliary voltage of FIG. 1 which, via the control element 4, assists in the starting process of the gas discharge lamp 3. The charging capacitor 10 functions in this connection as a source of DC voltage by which the gas discharge lamp 3 is fed. The lamp current is set by the current limiting circuit 11, in the simplest case an ohmic resistor but more advantageously a source of constant current.

For the starting of the gas discharge lamp 3, voltage pulses are superimposed on the operating voltage by the starting circuit 2. The diodes 12 and 13 serve for decoupling so that the voltage peaks do not pass back into the current supply. The diode 12 can also be replaced by a high-frequency choke and the diode 13 by a capacitor without any change in function resulting therefrom. During the starting process the lamp is connected via the control element 4 to the source of auxiliary voltage 5, which in this case is formed by the full-wave rectifier 6. After the starting of the lamp, this connection is automatically interrupted by means of the control element 4.

As starting circuit there can be used in this embodiment also, as shown in dashed line in FIG. 2, a starter transformer 17 which is connected in series with the charging capacitor 10 and generates a starting voltage pulse upon each charging current pulse. The high voltage is fed via the diode 16 to the gas discharge lamp 3. In this case the starting circuit 2 shown in solid line and the diode 13 are eliminated.

FIG. 3 shows an embodiment of the starting circuit 2 and current-limiting circuit 11 in the form of a source of constant current. The starting circuit is an ordinary thyristor pulse circuit.

The series connection of a resistor 18 and capacitor 19 is connected to the source of current 1, not shown in detail in this embodiment, at the terminals B, C in FIG. 2, the junction point being connected via a thyristor tetrode 20 with a starter transformer 17*a*. A control electrode of the thyristor tetrode 20 is connected to the division point of a voltage divider formed of the resistors 21, 22. The output of the starting circuit or else the secondary winding of the starter transformer 17*a* leads via the diodes 12, 13 to one pole of the gas discharge lamp 3, its other pole leading via the diode 14 and the current-limiting circuit 11 to the source of current 1.

In this embodiment the current-limiting circuit 11 has a transistor 24 whose base is connected via a resistor 27 to one pole of the source of current 1, its other pole being connected, via a current-determining resistor 25, to the emitter of the transistor 24. The series connection of the base-emitter path of the transistor 24 and resistor 25 is bridged by a zener diode 26.

Parallel to the source of current 1 there is furthermore a disconnect member 23 which, after the starting of the gas discharge lamp 3, prevents the production of further starting pulses, in particular via the cathode-side control connection of the thyristor tetrode 20.

In this embodiment also the starting is supported, via the control element 4, by the full auxiliary voltage which is supplied by the full-wave rectifier 6 of FIG. 2 via the terminal A and is greater than the lamp burning voltage.

The capacitor 19 is charged over the resistor 18 until its voltage exceeds the value established by the voltage divider formed by the resistors 21, 22, whereby a current pulse is passed through the starter transformer 17*a* and a voltage pulse is generated which is fed to the gas discharge lamp 3 via the diode 13.

Figure 4:
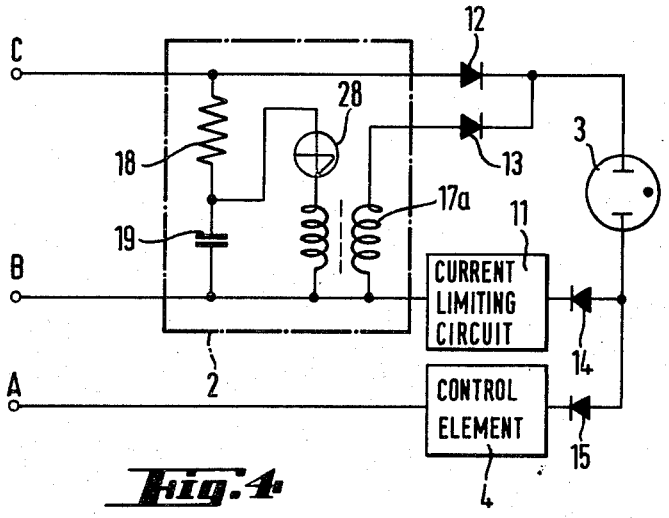
FIG. 4 shows an embodiment which has a starting circuit containing a four-layer diode which automatically terminates the starting process by reducing the operating voltage when the lamp is lit.

FIG. 4 shows an embodiment of the starting circuit 2 which is modified as compared with the embodiment of FIG. 3 and in which a four-layer diode 28 is used rather than the thyristor 20 but which otherwise corresponds to the embodiment shown in FIG. 3. The function of the circuit corresponds to that of the thyristor circuit. By selection of the trigger voltage of the four-layer diode 28, automatic termination of the starting process can be obtained in this case also after the starting of the gas discharge lamp 3 since, due to the operating current of the gas discharge lamp 3, the voltage at the charging capacitor 10 (FIG. 2) drops below the value of the trigger voltage of the four-layer diode 28.

Figure 5:
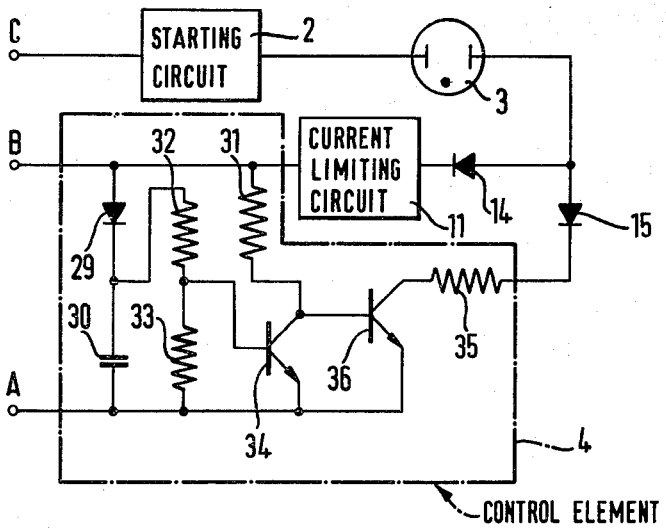
FIG. 5 shows an embodiment having a control element which, by means of a switch transistor, connects the gas discharge lamp with the source of auxiliary voltage over a resistor.

FIG. 5 shows an embodiment in accordance with FIG. 2 in which, in the same way as in the embodiments of FIGS. 3 and 4, the source of current 1 and the auxiliary voltage source 5 are not shown but their connections A, B, C merely indicated. This FIG. 5 shows in particular an example for the development of the control element 4.

To the terminals A, B, which can be short-circuited, for instance, by means of the switch contact 9 in FIG. 2, there is connected the series connection of a diode 29 and a capacitor 30 which is shunted by a voltage divider formed of resistors 32, 33 the junction point of which leads to the base of a transistor 34 whose collector is connected on the one hand via a resistor 31 to the terminal B and on the other hand to the base of a transistor 36 while its emitter is connected to the terminal A to which the emitter of the transistor 36 is also connected, the collector thereof being connected via a resistor 35 and the diode 15 to one pole of the gas discharge lamp 3.

As long as the gas discharge lamp 3 has not been started, the voltage at the charging capacitor 10 (FIG. 2) is high. As a result, the capacitor 30 is also charged via the diode 29 to a low voltage value which is not sufficient to make the transistor 34 conductive via the voltage divider 32, 33. In this way, the transistor 36 is conductive so that it connects the gas discharge lamp 3, via the diode 15 and the resistor 35, to the source of auxiliary voltage 5 (terminal A).

After the starting, the voltage of the charging capacitor 10 (FIG. 2) drops due to the operating current of the gas discharge tube 3, as a result of which the voltage at the capacitor 30 becomes greater and the transistor 34 becomes conductive and short-circuits the base-emitter path of the transistor 36. As a result, the latter blocks and interrupts the connection between the gas discharge lamp 3 and the source of auxiliary voltage (terminal A).

Figure 6:
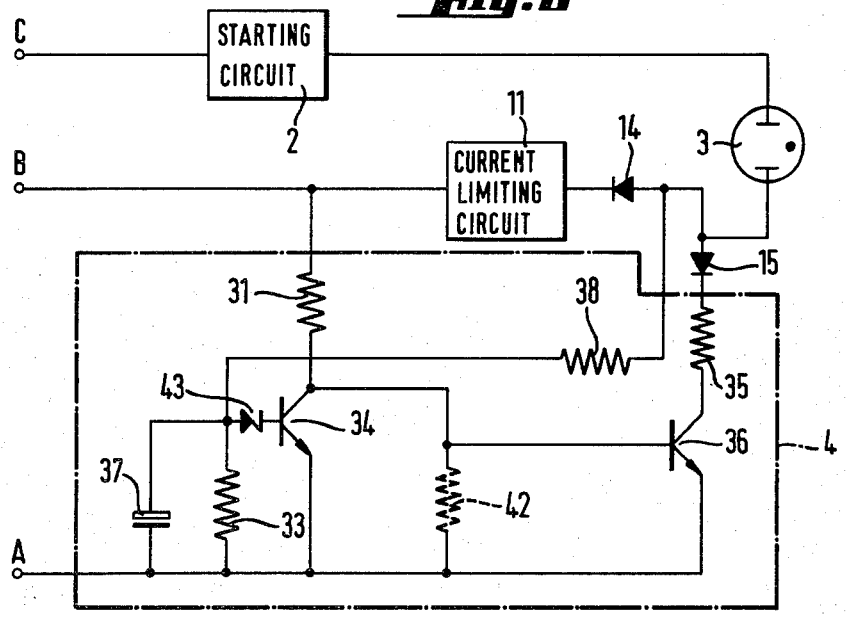
FIG. 6 shows a variant of the embodiment of FIG. 5.

FIG. 6 shows a variant of the control element of FIG. 5.

In this embodiment a capacitor 37 is connected in parallel with the resistor 33. The junction point between the resistor 33 and the capacitor 37 is connected on the one hand via a resistor 38 to the gas discharge lamp 3 and on the other hand via a zener diode 43 to the base of the transistor 34. Parallel to the base-emitter path of the transistor 36 there can also be connected a photoresistor 42, in which case the zener diode 43, the resistors 33, 38, the capacitor 37 and the transistor 34 can be omitted.

After the starting of the gas discharge lamp 3, the capacitor 37 is charged over the resistor 38. After a certain delay, the voltage at the capacitor 37 is so great that the transistor 34 becomes conductive, as a result of which the transistor 36 disconnects the gas discharge lamp 3 from the source of auxiliary voltage 5.

By the photoresistor 42 the result is obtained that when the gas discharge lamp 3 is lit the source of auxiliary voltage is disconnected from the gas discharge lamp 3.

By use of the zener diode 43 the connecting and disconnecting process is improved and the switch threshold becomes independent of variations in the power line.

In this circuit, for instance, the resistor 38 can also be replaced by a photoresistor which has optical contact with the gas discharge lamp 3 and the resistance of which, when the gas discharge lamp 3 is lit, is so reduced that the gas discharge lamp is separated from the source of auxiliary voltage (terminal A) via the transistors 34 and 36.

Figure 7:
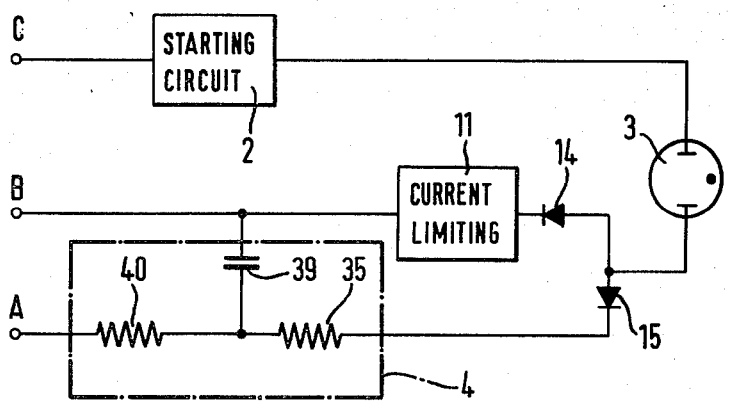
FIG. 7 shows an embodiment in which the control element is formed by the combination of a resistor and a capacitor.

FIG. 7 shows a simple control element in which a capacitor 39 slowly charges to a high voltage as long as the gas discharge lamp 3 has not been started. The capacitor 39 operates upon the starting of the gas discharge lamp as a source of auxiliary voltage and supports the starting process. After the starting, however, a slight residual current, limited in particular by the resistor 40 still flows in this case.

Figure 8:
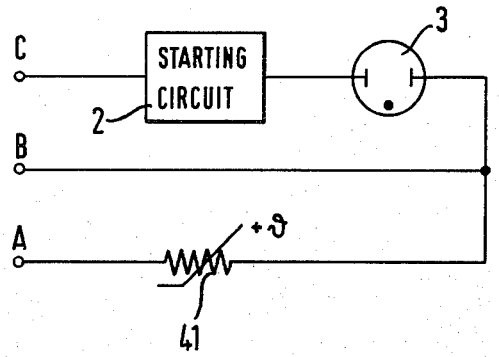
FIG. 8 shows an embodiment in which a ballast resistor is provided as control element.

In the embodiment shown in FIG. 8, a resistor 41 of positive temperature coefficient (ballast resistor) is connected between the gas discharge lamp 3 and the source of auxiliary voltage 5 as control element 4, its resistance increasing after the starting of the gas discharge lamp 3 in such a manner that now only a small residual current can flow through it.

The invention is not limited to the embodiments shown. Thus the disconnecting of the auxiliary voltage after the starting of the gas discharge lamp 3 can also be effected in a large number of other ways, for instance by means of an optical coupler.

We claim:

1. A circuit for the operating of gas discharge lamps, particularly fluorescent tubes, in which the gas discharge lamp is connected to a source of current, particularly a source of direct current, a starting circuit for starting the lamp and having a starter transformer as well as a source of auxiliary voltage which can be disconnected from the lamp after starting being provided for the starting of the gas discharge lamp, characterized by the fact that as the source of current there is provided a full-wave rectifier (6) with a connection via a control element (4) to the lamp and to which rectifier (6) there are connected in parallel a capacitor circuit and a switch control circuit (7), said capacitor circuit comprising a series combination of a charging capacitor (10) with a switch contact (9) actuated by said switch control circuit (7) in response to voltage developed across said rectifier, the charging capacitor (10) supplying the operating voltage for the gas discharge lamp (3) and being recharged to a voltage by successive closures of the switch control (9), and the full-wave rectifier (6) serving as source of auxiliary voltage for the gas discharge lamp (3), which, after the starting of the gas discharge lamp (3), can be disconnected via the control element (4), developed in particular as a semiconductor switch element, and by the fact that the starting circuit (2, 17) is connected to the charging capacitor (10) and that the secondary winding of the starter transformer (17, 17*a*) is connected to the gas discharge lamp (3) separately from the operating circuit of said lamp.

2. A circuit according to claim 1, characterized by the fact that the primary winding of the starter transformer (17) is connected in series with the charging capacitor (10) (FIG. 2).

3. A circuit according to claim 1, characterized by the fact that a series connection of a resistor (18) and a capacitor (19) is connected in parallel with the charging capacitor (10), a series connection of a thyristor tetrode (20), a four-layer diode (28) or the like and of the primary winding of the starter transformer (17*a*) being connected in parallel with the capacitor (19) (FIGS. 3 and 4).

4. A circuit according to claim 3, characterized by the fact that a disconnect member (23) by which the production of starting pulses can be interrupted after the gas discharge lamp (3) has been started is connected to the cathode-side control connection of the thyristor tetrode (20) (FIG. 3).

5. A circuit according to claim 1 characterized by the fact that as control element (4) there is provided a thyristor circuit in which a voltage divider (32, 33) is connected to the source of auxiliary voltage, in particular parallel to the switch contact (9), the division point of said voltage divider being connected with the base of a first transistor (34) whose collector is connected to the base of a second transistor (36) whose collector is connected to the gas discharge lamp (3) and whose emitter is connected to the source of auxiliary voltage (FIG. 5).

6. A circuit according to claim 5, characterized by the fact that the voltage divider (33, 38) is connected on the one hand to the gas discharge lamp (3) and on the other hand to the auxiliary voltage source (terminal A) (FIG. 6).

7. A circuit according to claim 5 or 6, characterized by the fact that the division point of the voltage divider (32, 33 or 33, 38) is connected to the base of the first transistor (34) via a zener diode (43).

8. A circuit according to claim 6, characterized by the fact that the resistor (38) connected to the gas discharge lamp (3) is developed as a light-dependent component, in particular as a photoresistor, which is in optical contact with the gas discharge lamp (3) (FIG. 6).

9. A circuit according to either claim 5 or 6, characterized by the fact that a photoelectric component, in particular a photoresistor (42), is connected in parallel to the base-emitter path of the second transistor (36) (FIG. 6).

10. A circuit according to any one of claims 1 to 4, characterized by the fact that as control element (4) there is provided a capacitor (39) which can be charged over a resistor (40) and which after the starting of the gas discharge lamp (3), shunts the source of auxiliary voltage, in particular the switch contact (9) (FIG. 7).

11. A circuit according to any one of claims 1 to 4, characterized by the fact that as control element (4) there is provided a resistor (41) with positive temperature coefficient, in particular a ballast resistor (FIG. 8).

12. A circuit for the operation of a gas discharge lamp, comprising:

a full-wave bridge rectifier providing electrical power to said lamp;

a capacitor coupled at a first terminal thereof to a first output terminal of said rectifier;

a switch connected between a second output terminal of said rectifier and a second terminal of said capacitor, there being a first current path connecting said first terminal of said capacitor to a first terminal of said lamp, there being a second current conducting path between a second terminal of said lamp and the junction of said switch and said capacitor, there being a third current conducting path between said second output terminal of said rectifier and said second terminal of said lamp;

a switch control circuit responsive to the output voltage of said rectifier developed between said first and said second output terminals of said rectifier connecting with said switch and operating said switch to provide a succession of closures thereof in response to pulsations in the output voltage of said rectifier; and means disposed within said third conducting path and activated by a voltage developed across an open contact of said switch for terminating the flow of current along said third conducting path, said capacitor providing power to said lamp during starting and running conditions thereof.

13. A circuit according to claim 12, further comprising a starting circuit coupled between said first current conducting path and said second current conducting path and including a starter transformer connected for receiving current from said capacitor for initiating operation of said lamp.

* * * * *